US005494057A

United States Patent [19]

Gianfrancesco

[11] Patent Number: 5,494,057

[45] Date of Patent: Feb. 27, 1996

[54] HAIRCUTTING AID AND METHOD

[75] Inventor: Daniel Gianfrancesco, Bridgewater, N.J.

[73] Assignee: Gianfarro, Inc., Green Brook, N.J.

[21] Appl. No.: 315,969

[22] Filed: Sep. 30, 1994

[51] Int. Cl.[6] ..... A45D 24/36

[52] U.S. Cl. ..... 132/214; 132/200

[58] Field of Search ..... 132/213, 214, 132/200

[56] References Cited

U.S. PATENT DOCUMENTS

| | | | |
|---|---|---|---|
| 1,504,436 | 8/1924 | Doughley . | |
| 1,858,252 | 5/1932 | Steinkamp . | |
| 2,749,922 | 6/1956 | Daniel et al. | 132/214 |
| 2,781,048 | 2/1957 | Le Donne | 132/214 |
| 2,808,840 | 10/1957 | De Santis | 132/214 |
| 2,936,767 | 5/1960 | McDonough | 132/214 |
| 3,010,459 | 11/1961 | Lerner . | |
| 3,407,823 | 10/1968 | Selvaggio . | |
| 3,935,870 | 2/1976 | Wall | 132/214 |
| 4,619,280 | 10/1986 | Yampolskaya | 132/214 |
| 4,830,031 | 5/1989 | Quinones et al. . | |
| 5,042,512 | 8/1991 | Knight . | |

FOREIGN PATENT DOCUMENTS

| | | |
|---|---|---|
| 652832 | 10/1928 | France . |

*Primary Examiner*—John G. Weiss
*Attorney, Agent, or Firm*—Selitto & Associates

[57] ABSTRACT

A haircutting aid for effecting a desired type of haircut includes a board for supporting hair thereon. A guiding mechanism is provided on the board for providing a guide along which a haircutting implement can be moved to cut hair supported on the board.

22 Claims, 4 Drawing Sheets

HAIRCUTTING AID AND METHOD

FIELD OF THE INVENTION

The present invention relates to haircutting aids, and, more particularly, to a method and an appliance which are useful in guiding a haircutting implement to achieve a desired type of haircut.

BACKGROUND OF THE INVENTION

A common style of haircut is facial flaming, in which hair is cut back to an angle around the face. Conventionally, this style is accomplished by freeform cutting of hair with a scissors. In freeform cutting, fingers are used to guide the angle of the hair around the face. This method of achieving facial framing has proven to be problematic because of difficulties experienced in positioning the fingers of one hand at an angle relative to the hair and then cutting the hair with scissors held in the other hand. Moreover, the hair on one side of the face must be visually compared to the hair on the other side of the face in attempting to make both sides even. Thus, this method makes it difficult to provide quick, efficient and precise facial framing.

haircutting aids have, in the past, been employed to assist in cutting or trimming a person's hair. For instance, U.S. Pat. No. 3,407,823 discloses a hair trimming guide adapted to be placed behind a person's head and fitted over the ears so that the guide forms a neck or ear guide line. U.S. Pat. No. 1,504,436 relates to a shaving gauge placed around the ear for shaving sideburns. In both instances, the device is placed over the hair and the underlying hair is trimmed by using an edge of the device as a gauge. Thus, the style of haircut is limited to one which is predetermined by the edge of each device. Moreover, neither device is adaptable for use in effecting a facial framing type of cut.

SUMMARY OF THE INVENTION

The problems and disadvantages associated with the prior art devices described above are overcome in accordance with the present invention by providing a new and improved haircutting method and aid having the ability to effect different styles of haircuts, such as a facial framing cut, in a quick, efficient and precise manner. More particularly, the present invention employs a haircutting aid which includes a board adapted to support hair thereon and a guide along which a haircutting implement can be moved to cut hair supported on the board.

To perform a haircutting operation, the board is positioned adjacent to a person's head. After positioning the hair to be cut on the board, the hair is cut by moving a haircutting implement along the guide.

In one embodiment, the guide includes a set of indicia along which a haircutting implement can be traced to cut hair supported on the board. In an alternate embodiment, the guide includes a template removably attached to the board, the template having an edge along which a haircutting implement can be moved to cut hair supported between the board and the template.

BRIEF DESCRIPTION OF THE DRAWINGS

For a better understanding of the present invention, reference is made to the following description of two exemplary embodiments of the invention considered in conjunction with the accompanying drawings, in which.

DETAILED DESCRIPTION OF THE EXEMPLARY EMBODIMENTS

Although the present invention can be used in effecting many different styles of haircuts, it is particularly suitable for use in effecting a facial framing type of cut. Accordingly, the present invention will be described hereinafter in connection with such a cut. It should be understood, however, that the following description is only meant to be illustrative of the present invention and is not meant to limit the scope of the present invention, which has applicability in effecting other styles of haircuts.

Figure 1:
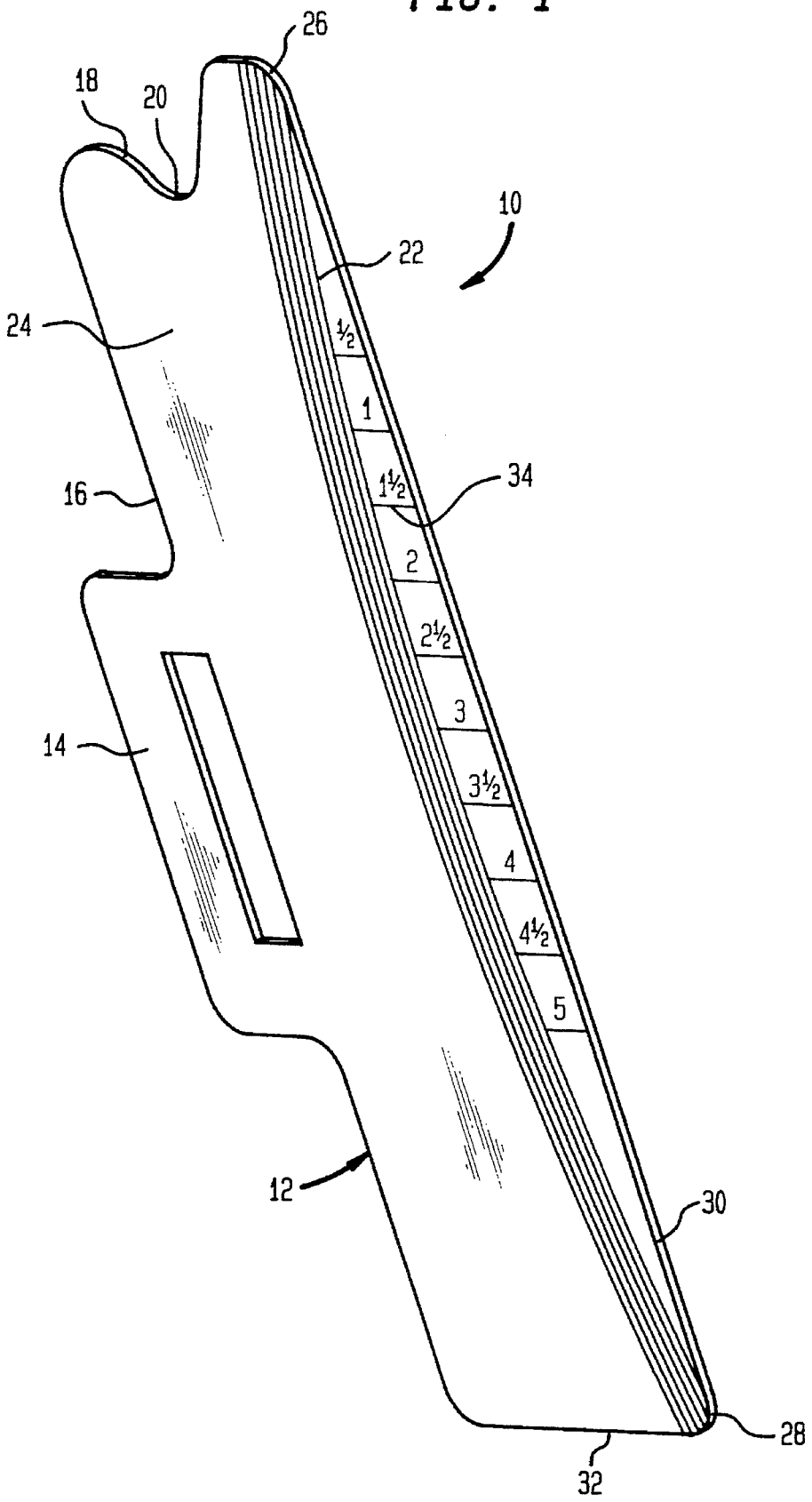
FIG. 1 is a top perspective view of a haircutting aid which is constructed in accordance with one exemplary embodiment of the present invention.
Figure 2:
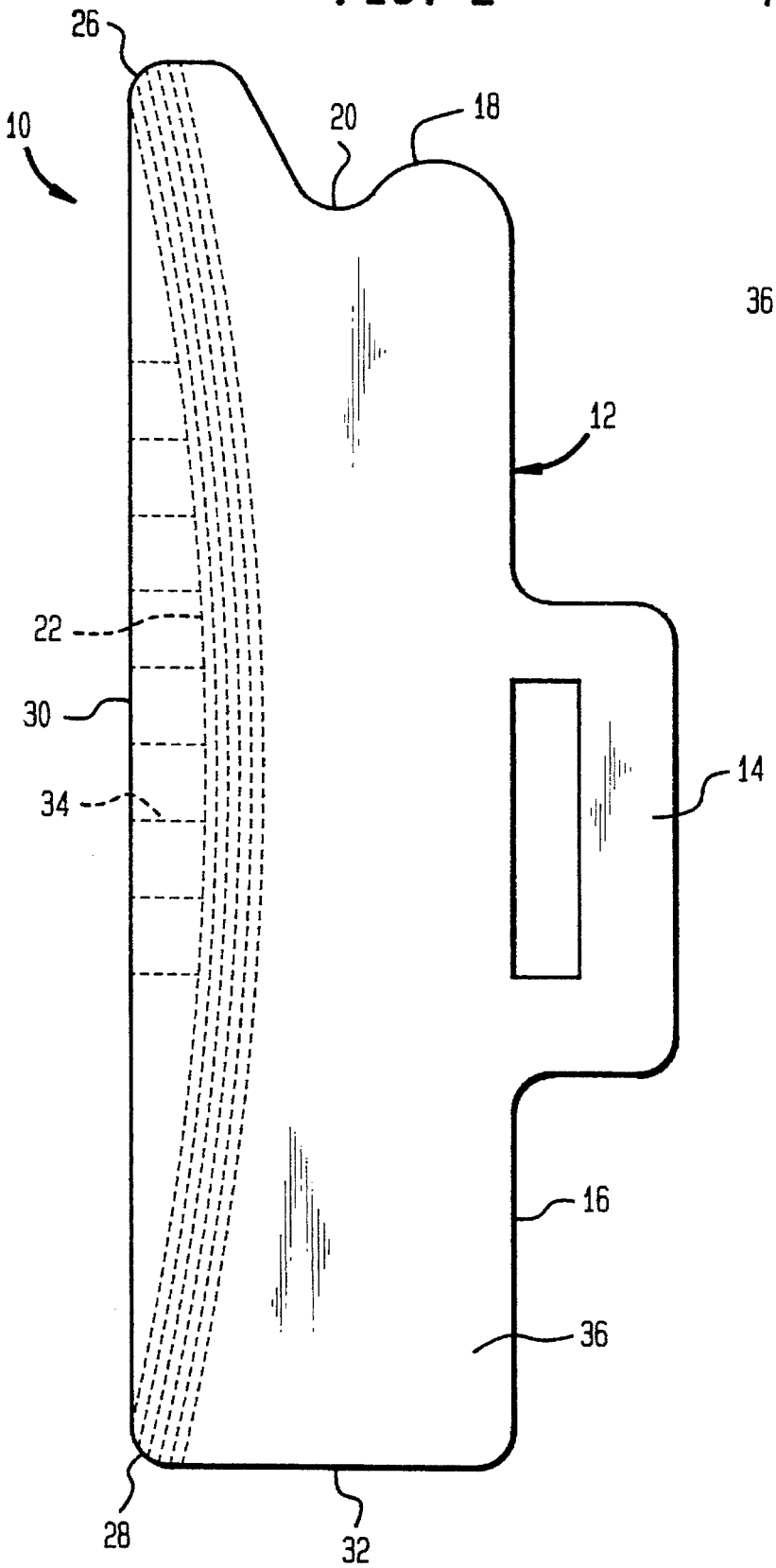
FIG. 2 is a rear plan view of the haircutting aid illustrated in FIG. 1.
Figure 3:
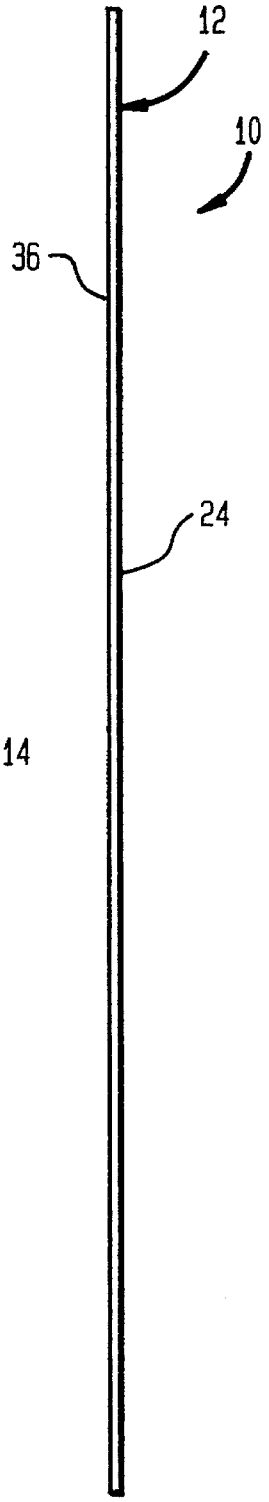
FIG. 3 is a left side elevational view of the haircutting aid illustrated in FIG. 1.

Referring to FIGS. 1–3, a haircutting aid 10 includes a haircutting board 12 which is equipped with a handle 14 along a side edge 16 of the board 12. A top edge 18 of the board 12 is contoured to generally correspond to the hairline on a side of a person's head and includes a groove 20 for purposes to be discussed hereinafter. The board 12 also includes a plurality of arcuate lines 22 permanently positioned on a front surface 24 of the board 12 by any conventional method, such as hot stamping or screening. More particularly, the arcuate lines 22 extend from a top corner 26 of the board 12 to a bottom corner 28 of the board 12. The top corner 26 is formed by the intersection of the top edge 18 and a side edge 30 of the board 12, the side edge 30 being opposite the side edge 16. The bottom corner 28 is formed by the intersection of a bottom edge 32 of the board 12 and the side edge 30. Each of the arcuate lines 22 has a predetermined curvature which corresponds to a particular style of facial framing haircut. A plurality of straight lines 34 are also permanently positioned on the front surface 24 of the board 12 by any conventional method, such as hot stamping or screening. More particularly, the straight lines 34 extend from the arcuate lines 22 to the side edge 30 of the board 12 and are substantially perpendicular to the side edge 30. The straight lines 34 are metered (i.e., provided with markings such as "½ inch", "1 inch", etc.).

Referring primarily to FIG. 3, the haircutting board 12 is relatively thin, but nevertheless rigid. The board 12 is made out of a transparent material, such as plexiglass, whereby the arcuate lines 22 and the straight lines 34 are visible from a rear surface 36 (see FIG. 2) of the board 12 for purposes to be discussed hereinafter.

Figure 4:
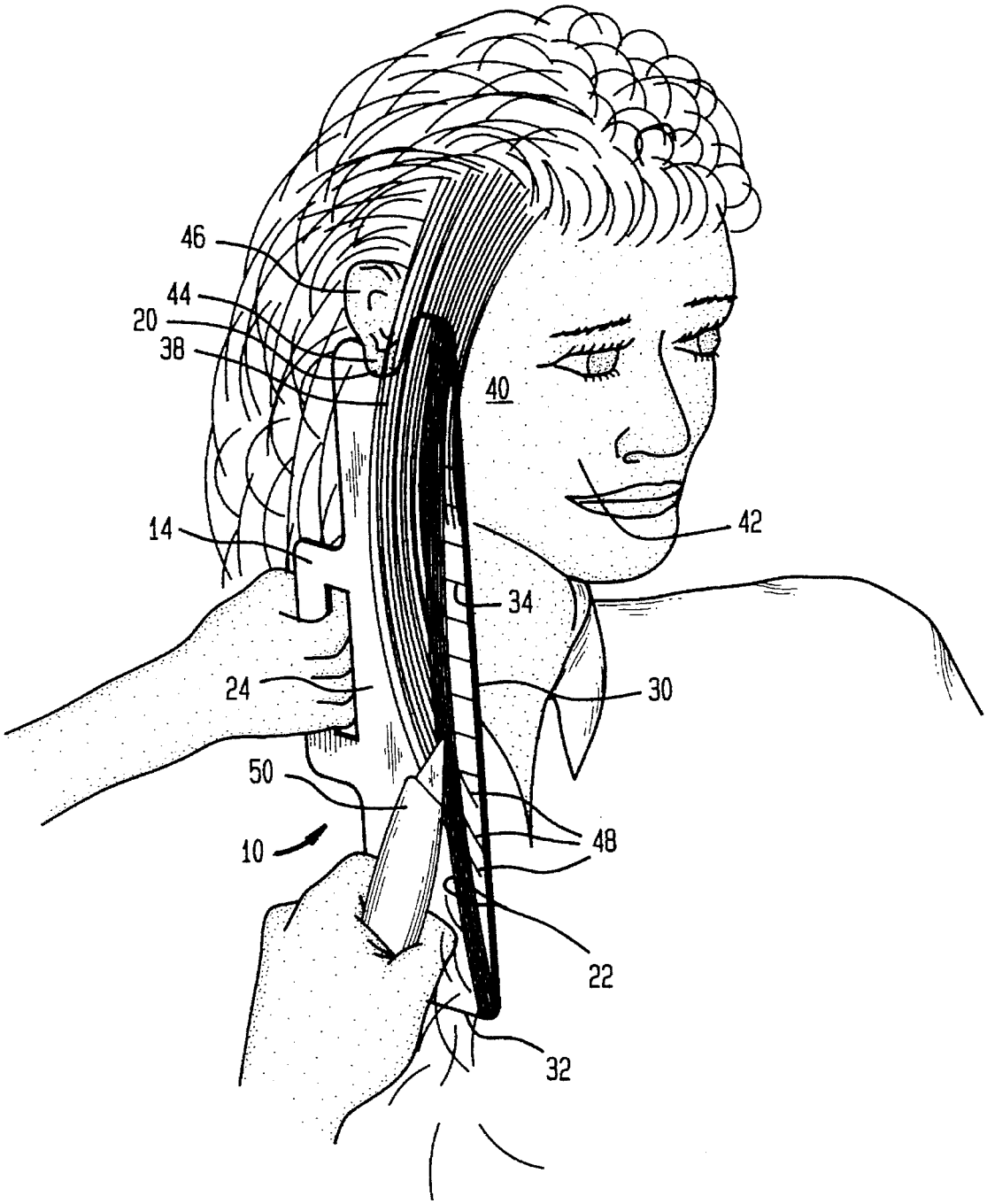
FIG. 4 is a side perspective view showing the haircutting aid of FIGS. 1–3 in use.

Referring to FIG. 4, with the handle 14 being held by an individual whose hair 38 is to be cut, the haircutting aid 10 is positioned on a right side 40 of the individual's face 42. More particularly, with the side edge 30 facing forwardly, the front surface 24 facing away from the right side 40 of the face 42, and the bottom edge 32 facing downwardly, the haircutting aid 10 is aligned with the right side 40 of the face 42 by positioning a bottom portion 44 of the individual's right ear 46 in the groove 20 such that the straight lines 34 are substantially horizontal. The hair 38 is wetted with water, gel and/or lotion to increase the adherence of the hair 38 to the front surface 24 of the board 12. The hair 38 is arranged on the board 12 by combing it in an arc over the front surface 24 of the board 12. As shown in FIG. 4, the curvature of the hair 38 is different from the curvature of the arcuate lines 22 such that an end portion 48 of the hair 38 extends diagonally across the arcuate lines 22. After selecting one of the arcuate lines 22 as a guide, the hair 38 is cut by tracing the selected arcuate line 22 downwardly with a razor 50. The hair 38 is then cut along a selected one of the straight lines 34, either with the razor 50 or with scissors (not shown), such that the hair 38 on the right side 40 is cut to a particular length.

After the hair 38 on the right side 40 of the face 42 is cut, the haircutting aid 10 is positioned on a left side (not shown) of the face 42, and the foregoing procedure is repeated. More particularly, with the side edge 30 facing forwardly, the rear surface 36 facing away from the left side of the face 42, and the bottom edge 32 facing downwardly, the haircutting aid 10 is aligned with the left side of the face 42 by positioning a bottom portion of the individual's left ear (not shown) in the groove 20 such that the straight lines 34 are substantially horizontal. The hair (not shown) is wetted with water, gel and/or lotion to increase its adherence to the rear surface 36 of the board 12. The hair is arranged on the board 12 by combing it in an arc over the rear surface 36 of the board 12 such that an end portion of the hair extends diagonally across the arcuate lines 22. The hair on the left side is then cut along the same arcuate and straight lines used to guide the cut on the right side of the individual's face 42, thereby achieving a symmetrical facial flaming haircut in a quick, efficient and precise manner.

Because the arcuate lines 22 and the straight lines 34 are visible from both the front surface 24 and the rear surface 36 of the haircutting aid 10, the haircutting aid 10 can be used to cut hair on both sides of the face 42 without rotating or flipping it. Further, by using the haircutting aid 10, it is not necessary to visually gauge the hair on one side of the face relative to the hair on the other side to make both sides even.

It should be noted that the haircutting aid 10 can have various configurations. For instance, the curvature of the arcuate lines 22 may vary to effect hair styles other than Facial framing. Further, the top edge 18 of the haircutting aid 10 may have a different contour than the contour shown in FIGS. 1 and 2. In addition, some or all of the arcuate lines 22 and straight lines 34 can be positioned on the rear surface 36 of the haircutting aid 10. The arcuate lines 22 and the straight lines 34 may also be removably positioned on the haircutting aid 10 and/or protected flora obliteration by providing a laminate over the arcuate lines 22 and the straight lines 34. The handle 14 may be omitted or replaced by any conventional mechanism for holding the haircutting aid 10 adjacent to an individual's head.

It should also be noted that the method of cutting hair can include many variations. For instance, several of the arcuate lines 22 and the straight lines 34, instead of one of the arcuate lines 22 and one of the straight lines 34, can be selected as guides and references, respectively, for a different facial flaming effect. Further, the step of wetting the hair to be cut with water, gel and/or lotion may be omitted. The haircutting aid 10 may also be positioned over, instead of under, an individual's ear such that the contour of the top edge 18 is aligned with the hairline on the side of the face. In addition, the hair on the left side of the face may be cut first.

Figure 5:
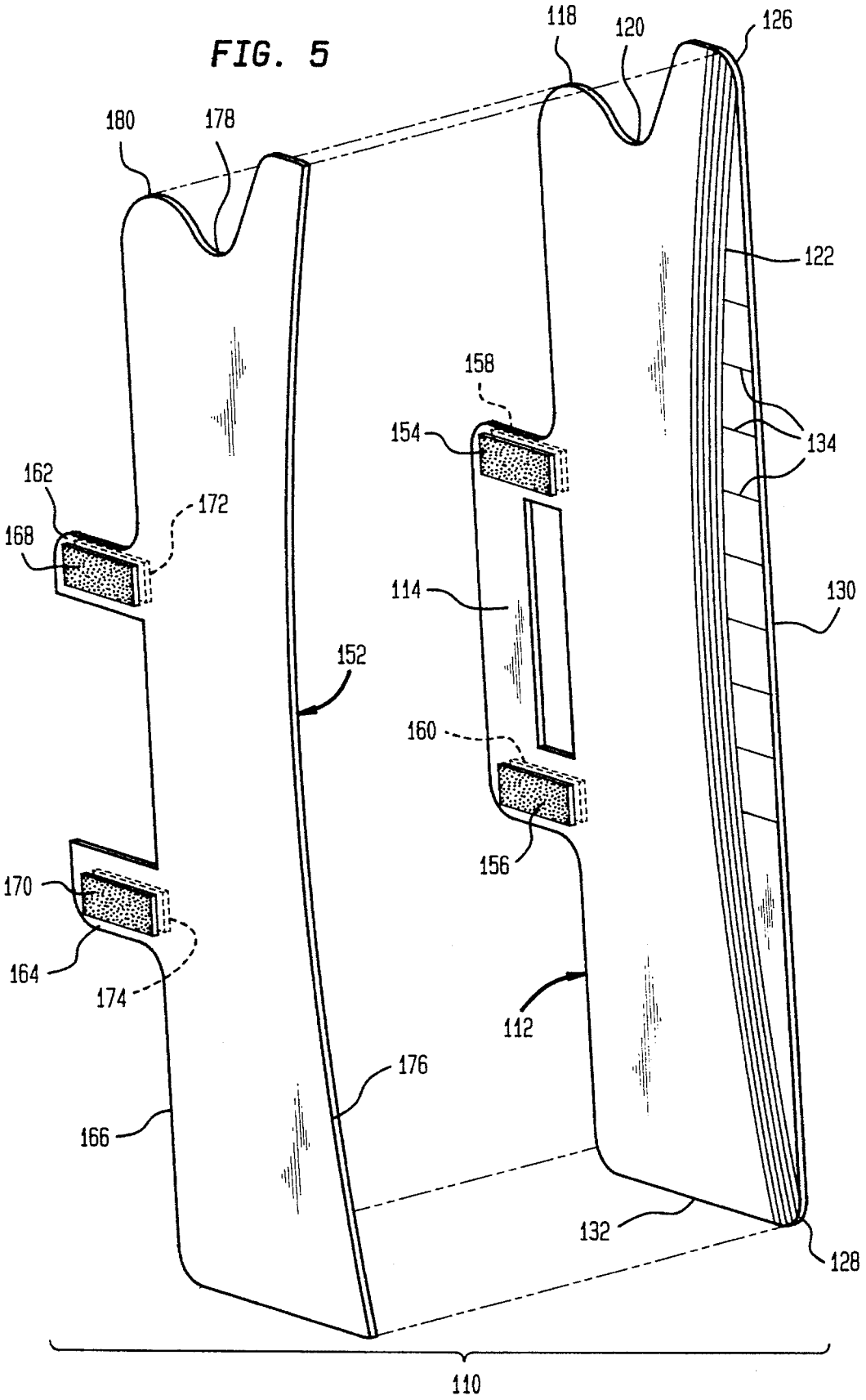
FIG. 5 is an exploded perspective view of another exemplary embodiment of a haircutting aid constructed in accordance with the present invention.

FIG. 5 depicts another exemplary embodiment of a haircutting aid constructed in accordance with the present invention. The embodiment of FIG. 5 is constructed and used in the same manner as the embodiment in FIGS. 1–4 unless it is otherwise stated. Accordingly, in FIG. 5, a numbering convention is employed wherein elements shown therein having a function or structure in common with a counterpart in previously discussed FIGS. 1–4 are given the same reference numerals incremented by a hundred.

Referring to FIG. 5, a haircutting aid 110 includes a haircutting board 112 and a complementary template 152 which is removably attached to the board 112. The board 112 is constructed in the same manner as the board 12 of FIGS. 1–4 except that the handle 114 of the board 112 includes a pair of Velcro-type fasteners 154, 156 on a front surface of the board 112 and a pair of Velcro-type fasteners 158, 160 on a rear surface of the board 112.

The template 152 includes a pair of tabs 162, 164 at a side edge 166 thereof. The tabs 162, 164 include a pair of Velcro-type fasteners 168, 170, respectively, on a front surface of the template 152 and a pair of Velcro-type fasteners 172, 174, respectively, on a rear surface of the template 152. The fasteners 168, 170 on the front surface of the template 152 are adapted for removable attachment to the fasteners 158, 160, respectively, on the rear surface of the board 112, while the fasteners 172, 174 on the rear surface of the template 152 are adapted for removable attachment to the fasteners 154, 156 on the front surface of the board 112.

The template 152 also includes an arcuate side edge 176 opposite the side edge 166 of the template 152. The arcuate side edge 176 corresponds to one of the arcuate lines 122 of the board 112 in shape, size and curvature. Alternatively, the arcuate side edge 176 may have a predetermined curvature which correspond to a particular style of facial framing haircut and which is different from the curvature of the arcuate lines 122. The template 152 also includes a groove 178 at a top edge 180 which is contoured to correspond in shape, size and curvature to a top edge 118 of the board 112. Like the board 112, the template 152 is made out of a transparent material such that the arcuate lines 122 and the straight lines 134 are visible through the template 152 when it is attached to the front surface or the rear surface of the board 112.

In cutting hair, the haircutting aid 110 is used in the same manner as the haircutting aid 10 of FIG. 1–4 except as discussed hereinafter. After arranging the hair on the right side of an individual's face on the front surface of the board 112, the rear surface of the template 152 is attached to the front surface of the board 112 via the fasteners 154, 156, 172, 174 such that the arcuate side edge 176 of the template 152 is aligned with a corresponding one of the arcuate lines 122 of the board 112 and such that the hair is positioned between the template 152 and the board 112. The hair is then cut by using the arcuate side edge 176 as a guide for a razor or a similar haircutting implement. After removing the template 152 from the board 112, the hair on the right side is cut along a selected one of horizontal lines 134 of the board 112 either with the razor or a scissors.

Next, the hair on the left side of the face is arranged on the rear surface of the board 112, and the front surface of the template 152 is attached to the rear surface of the board 112 via the fasteners 158, 160, 168, 170 such that the arcuate side edge 176 of the template 152 is aligned with the corresponding one of the arcuate lines 122 of the board 112 and such that the hair is positioned between the template 152 and the board 112. The hair is then cut by using the arcuate side edge 176 as a guide for the razor or similar haircutting implement. After removing the template 152 from the board 112, the hair on the right side is cut along the selected one of the horizontal lines 134, either with the razor or a scissors, thereby achieving a symmetrical facial framing haircut in a quick efficient, and precise manner.

Because the hair is securely held in place by the board 112 and the template 152, the template 152 provides an additional support for supporting the hair to be cut. Further, the template 152 provides a physical guide (i.e., the arcuate side edge 176) along which a razor can be moved allowing the hair to be cut very precisely.

It should be noted that the haircutting aid 110 can have various configurations in addition to those depicted in FIGS. 1–4. For instance, the curvature of the arcuate side 176 of the template 152 may vary to effect hair styles other than facial framing. Further, the top edge 180 of the template 152 may have a different contour than the contour shown in FIG. 5 or the contour of the top edge 118 of the board 112. In addition, some or all of the arcuate lines 122 and straight lines 134 can be positioned on the front surface or the rear surface of the template 152. The arcuate lines 122 may also be omitted from the haircutting aid 110. The haircutting aid 110 may also include several templates 152 each having a predetermined curvature corresponding to a different style of facial framing haircut. Further, any conventional attaching mechanism, such as magnetic-type fasteners, may be utilized to removably attach the template 152 to the board 112.

It will be understood that the embodiment described herein is merely exemplary and that a person skilled in the art may make many variations and modifications without departing from the spirit and scope of the invention. All such modifications and variations are intended to be included within the scope of the invention as defined in the appended claims.

I claim:

1. A haircutting aid, comprising supporting means for supporting hair thereon, said supporting means including a substantially rigid and planar board which includes a first surface on one side of said board, said first surface being substantially flat and providing one cutting surface for hair supported thereon, and a second surface on an opposite side of said board, said second surface being substantially flat and providing another cutting surface for hair supported thereon; guiding means for providing a guide along which a haircutting implement can be moved to cut hair supported on said first surface or said second surface, said guiding means providing visible guide indicia on both said first and second surfaces; and gripping means for providing a handgrip along said board, whereby said board can be held adjacent to either side of a person's head in order to achieve a facial framing cut.

2. The haircutting aid of claim 1, wherein said one cutting surface is engageable by a haircutting implement; and wherein said another cutting surface is engageable by a haircutting implement.

3. The haircutting aid of claim 2, wherein said guiding means includes a first set of indicia.

4. The haircutting aid of claim 3, wherein said first set of indicia includes a plurality of arcuate lines.

5. The haircutting aid of claim 4, wherein said arcuate lines are positioned on said first surface of said board.

6. The haircutting aid of claim 5, wherein said arcuate lines are positioned adjacent to one side edge of said board.

7. The haircutting aid of claim 6, wherein said guiding means includes a second set of indicia.

8. The haircutting aid of claim 7, wherein said second set of indicia includes a plurality of straight lines.

9. The haircutting aid of claim 8, wherein said straight lines are positioned on said first surface of said board.

10. The haircutting aid of claim 9, wherein said straight lines extend from said arcuate lines to said one side edge of said board.

11. The haircutting aid of claim 10, wherein said board is transparent such that said arcuate lines and said straight lines are visible from said second surface of said board.

12. The haircutting aid of claim 11, further comprising aligning means for aligning said board on a side of a person's face.

13. The haircutting aid of claim 12, wherein said aligning means is provided at one end of said board.

14. The haircutting aid of claim 13, wherein said one end of said board is contoured to correspond to a hairline on a side of a person's face.

15. The haircutting aid of claim 14, wherein said one end of said board includes a groove sized and shaped so as to cover a person's ear.

16. The haircutting aid of claim 15, wherein said gripping means includes a handle attached to said board.

17. The haircutting aid of claim 14, wherein said one end of said board includes a groove shaped and sized to receive a person's ear.

18. A haircutting aid, comprising supporting means for supporting hair thereon, said supporting means including a board on which hair can be positioned to be cut; and guiding means for providing a guide along which a haircutting implement can be moved to cut hair supported on said supporting means, said guiding means including a template removably attached to said board.

19. The haircutting aid of claim 18, wherein said template includes an arcuate edge along which a cutting implement can be moved to cut hair supported between said board and said template.

20. A method for cutting hair to achieve a facial framing cut through the use of a haircutting aid which includes supporting means for supporting hair thereon, said supporting means including a substantially rigid and planar board which includes a first surface on one side of said board, said first surface being substantially flat and providing one cutting surface for hair supported thereon, and a second surface on an opposite side of said board, said second surface being substantially flat and providing another cutting surface for hair supported thereon; guiding means for providing a guide along which a haircutting implement can be moved to cut hair supported on said first surface or said second surface, said guiding means providing visible guide indicia on both said first and second surfaces; and gripping means for providing a handgrip along said board, said method comprising the steps of positioning said haircutting aid adjacent to one side of a person's head; gripping said handgrip so as to maintain said haircutting aid adjacent to said one side of the person's head; positioning hair to be cut on said first surface; cutting the hair positioned on said first surface by moving a haircutting implement over said one cutting surface along a path defined by said guide indicia visible on said first surface; positioning said haircutting aid adjacent to an opposite side of the person's head; gripping said handgrip so as to maintain said haircutting aid adjacent to said opposite side of the person's head; positioning hair to be cut on said second surface; cutting the hair positioned on said second surface by moving a haircutting implement over said another cutting surface along a path defined by said guide indicia visible on said second surface.

21. The method of claim 20, wherein said cutting steps are performed by using a razor–type haircutting implement.

22. The method of claim 21, wherein the person's hair is gelled before performing said cutting steps.

* * * * *

UNITED STATES PATENT AND TRADEMARK OFFICE

CERTIFICATE OF CORRECTION

PATENT NO. : 5,494,057

DATED : February 27, 1996

INVENTOR(S) : Daniel Gianfrancesco

It is certified that error appears in the above-indentified patent and that said Letters Patent is hereby corrected as shown below:

Column 1, line 12, delete "flaming" and insert --framing--.
line 25, delete "haircutting" and insert --Haircutting--.

Column 3, line 30, delete "flaming" and insert --framing--.
line 42, delete "Facial" and insert --facial--.
line 48, delete "flora" and insert --from--.
line 58, delete "flaming" and insert --framing--.

Signed and Sealed this

Eighteenth Day of June, 1996

*Attest:*

Bruce Lehman

BRUCE LEHMAN

*Attesting Officer*

*Commissioner of Patents and Trademarks*